US006422876B1

(12) United States Patent
Fitzgerald et al.

(10) Patent No.: US 6,422,876 B1
(45) Date of Patent: Jul. 23, 2002

(54) HIGH THROUGHPUT INTERCONNECTION SYSTEM USING ORTHOGONAL CONNECTORS

(75) Inventors: John J. Fitzgerald, Lunenburg; Geoffrey B. Ladwig, Chelmsford; Richard L. Angle, Wellesley Hills; Jeffrey V. Bean, Fitchburg, all of MA (US)

(73) Assignee: Nortel Networks Limited, St. Laurent (CA)

( * ) Notice: Subject to any disclaimer, the term of this patent is extended or adjusted under 35 U.S.C. 154(b) by 0 days.

(21) Appl. No.: 09/457,508

(22) Filed: Dec. 8, 1999

(51) Int. Cl.[7] ..... H01R 12/00

(52) U.S. Cl. ..... 439/61; 439/74; 439/631; 361/784

(58) Field of Search ..... 439/60, 61, 62, 439/631, 74; 361/784, 785

(56) References Cited

U.S. PATENT DOCUMENTS

| | | | | | |
|---|---|---|---|---|---|
| 4,498,717 | A | * | 2/1985 | Reimer | 339/17 |
| 4,504,783 | A | | 3/1985 | Zasio et al. | |
| 4,838,798 | A | * | 6/1989 | Evans et al. | 439/61 |
| 5,383,793 | A | | 1/1995 | Hsu et al. | |
| 5,395,259 | A | | 3/1995 | Casses | |
| 5,485,096 | A | | 1/1996 | Aksu | |
| 5,525,795 | A | | 6/1996 | MacGregor et al. | |
| 5,908,333 | A | * | 6/1999 | Perino et al. | 439/631 |
| 5,978,873 | A | | 11/1999 | Phan | |
| 5,994,894 | A | * | 11/1999 | Fujita | 324/158.1 |
| 6,008,985 | A | | 12/1999 | Lake et al. | |
| 6,059,592 | A | | 5/2000 | Inadama | |
| 6,089,889 | A | | 7/2000 | Chiou et al. | |
| 6,163,464 | A | * | 12/2000 | Ishibashi et al. | 361/788 |

* cited by examiner

*Primary Examiner*—Tho D. Ta
*Assistant Examiner*—Truc Nguyen
(74) *Attorney, Agent, or Firm*—Blakely Sokoloff Taylor & Zafman, LLP

(57) ABSTRACT

The present invention is a method and apparatus for interconnection system. A first front connector is located at a side of a first front card to provide first contacts for first signal traces on the first front card. A second front connector located at a side of a second front card to provide second contacts for second signal traces on the second front card. A mating connector has first and second receptacles and is located alongside of a rear card. The mating connector electrically connects the first contacts of the first signal traces to the second contacts of the second signal traces via contacts in the first and second receptacles. The first and second receptacles couple to the first and second front connectors, respectively. The rear card is positioned in a substantially orthogonal direction to the first and second front cards.

6 Claims, 4 Drawing Sheets

HIGH THROUGHPUT INTERCONNECTION SYSTEM USING ORTHOGONAL CONNECTORS

BACKGROUND

1. Field of the Invention

The present invention is related to interconnection systems. In particular, the present invention is related to interconnection systems using orthogonal connectors.

2. Description of Related Art

As data communication rates become higher and higher to meet demanding applications, interconnecting printed circuit boards (PCB) or cards in communication systems becomes more and more important. Signal transmission rate depends on a number of factors. One important factor is the length of the signal trace on the PCB. The shorter the length, the faster the signal can propagate. When the signal density is high, the interconnection of the signals for high speed applications becomes a challenge.

FIG. 1 shows a prior art interconnection system. For illustrative purposes, only two front cards are shown. The prior art system 100 includes two front cards 110 and 120, a midplane 130, and a rear card 140.

The front cards 110 and 120 have signal traces 118 and 128 and front connectors 115 and 125, respectively. The signal traces are terminated with contact points in the corresponding connectors. One objective of the interconnection system is to connect the signal traces 118 on the front card 110 to the corresponding signal traces 128 on the front card 120. The connectors 115 and 125 are typically full-length connectors having as many contact points as necessary to accommodate the interconnecting of the signal traces on the front cards.

The midplane has mating connectors 132 and 134 to mate with the front card connectors 115 and 125. The midplane 130 also has signal traces 138 running between the mating connectors 132 and 134 to form electrical connections for the contact points in the connectors 115 and 125. The rear card 140 provides additional area for signal traces. The rear card 140 is interfaced to the midplane via a rear connector 145.

The prior art system 100 has a number of disadvantages. First, the full-length configuration of the connectors 115 and 125 reduces the routing flexibility on the front cards 110 and 120 and the midplane 130. Second, the interconnecting signal trace lengths are long, resulting in higher propagation delay and lower speed. Third, the complexity and hardware cost for the midplane can be very high. The midplane may have many internal layers to accommodate all the interconnecting signals.

Therefore, there is a need to have an efficient technique for interconnecting cards in a high speed environment.

SUMMARY

The present invention is a method and apparatus for interconnection system. A first front connector is located at a side of a first front card to provide first contacts for first signal traces on the first front card. A second front connector located at a side of a second front card to provide second contacts for second signal traces on the second front card. A mating connector has first and second receptacles and is located along a side of a rear card. The mating connector electrically connects the first contacts of the first signal traces to the second contacts of the second signal traces via contacts in the first and second receptacles. The first and second receptacles couple to the first and second front connectors, respectively. The rear card is positioned in a substantially orthogonal direction to the first and second front cards.

According to one embodiment of the present invention, the first and second receptacles have contacts to electrically connect the first contacts to the second contacts via rear signal traces on the rear card. In another embodiment, a midplane is coupled to the mating connector and positioned in a substantially orthogonal direction to the first, second, and rear cards. The midplane provides additional signal traces connecting the contacts in the first and second connectors to the contacts in first and second receptacles.

The advantages of the invention include high signal transmission rates, high signal density, routing flexibility, low midplane cost, balanced mechanical structure, and reduced overall mechanical stress.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

The features and advantages of the present invention will become apparent from the following detailed description of the present invention in which.

DESCRIPTION

The present invention is a method and apparatus for interconnection system. A first front connector is located at a side of a first front card to provide first contacts for first signal traces on the first front card. A second front connector located at a side of a second front card to provide second contacts for second signal traces on the second front card. A mating connector has first and second receptacles and is located along a side of a rear card. The mating connector electrically connects the first contacts of the first signal traces to the second contacts of the second signal traces via contacts in the first and second receptacles. The first and second receptacles couple to the first and second front connectors, respectively. The rear card is positioned in a substantially orthogonal direction to the first and second front cards.

In the following description, numerous specific details are set forth in order to provide a thorough understanding of the present invention. It will be apparent, however, to one of ordinary skill in the art that the present invention may be practiced without these specific details. In other instances, well-known architectures, steps, and techniques have not been shown where unnecessary for an understanding of the present invention. For example, specific details are not provided as to whether the method is implemented in a station as a software routine, hardware circuit, firmware, or a combination thereof.

Figure 1:
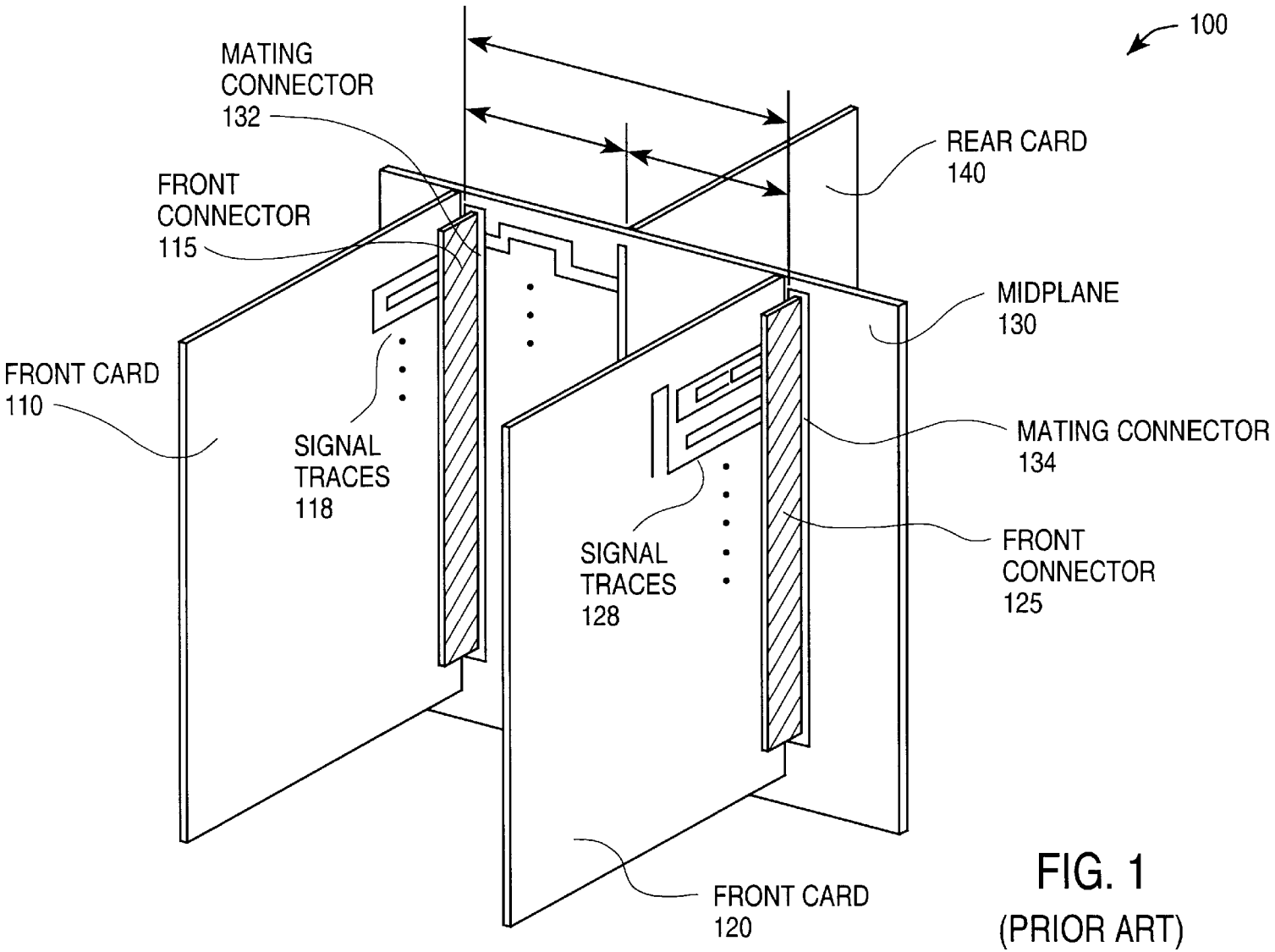
FIG. 1 (PRIOR ART)
FIG. 1 is a diagram illustrating a prior art interconnection system.
Figure 2:
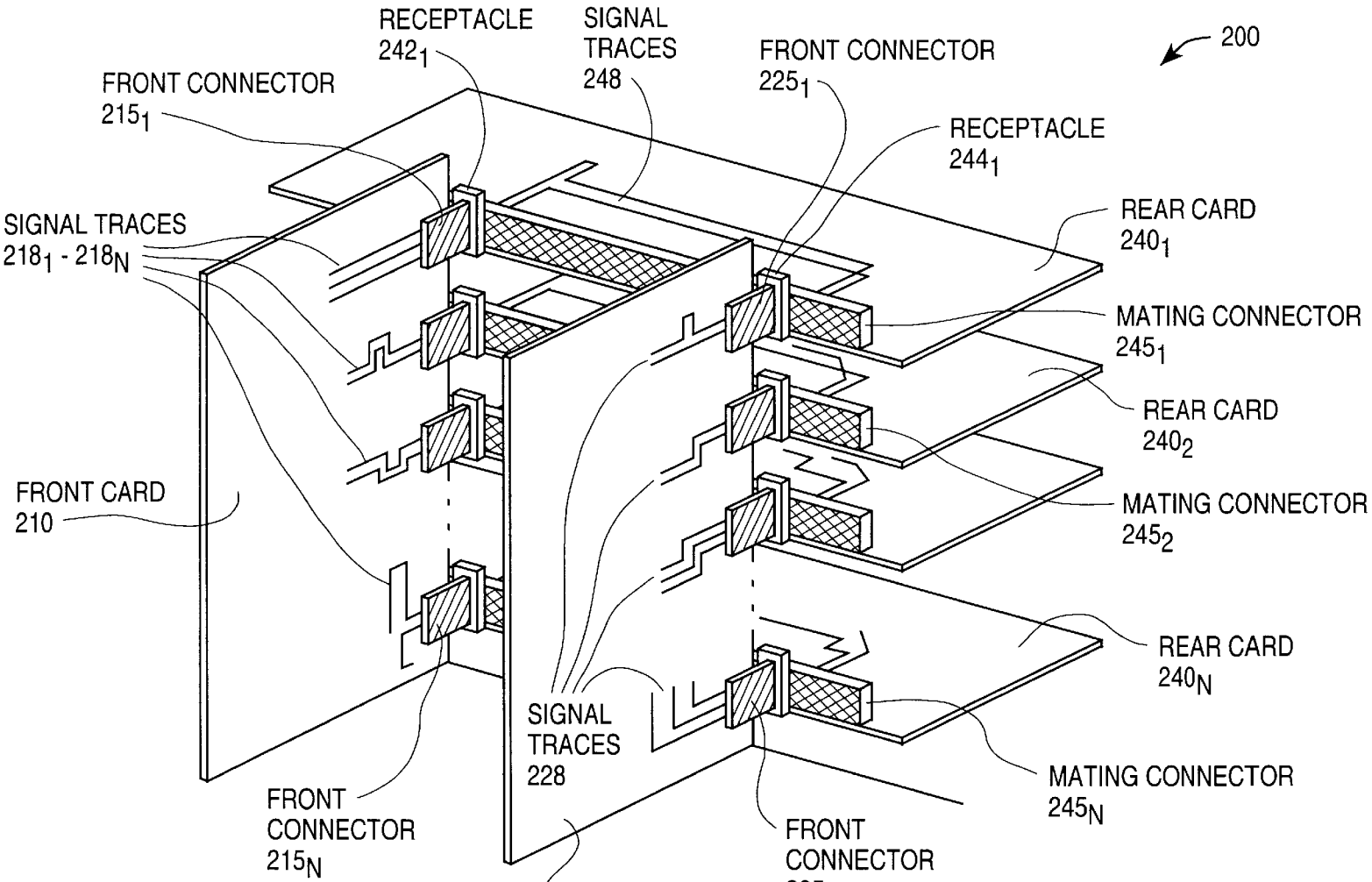
FIG. 2 is a diagram illustrating an interconnection system using orthogonal connectors without midplane according to one embodiment of the invention.

FIG. 2 is a diagram illustrating an interconnection system 200 using orthogonal connectors without midplane according to one embodiment of the invention. The system 200 includes two front cards 210 and 220, M mating connectors 2451 to 245N, and M rear cards 2401 to 240N. For illustrative purposes, only two front cards are shown. Obviously, the system can accommodate as many front cards as necessary.

The front card 210 has N front connectors 2151 to 215N located at one side of the card. The front connectors 2151 to 215N are arranged to provide contact points for the signal traces 2181 to 218N, respectively. The front connectors 2151 to 215N are spaced such that there are sufficient gaps between two adjacent connectors. These gaps provide routing flexibility when signal traces have to run around the corresponding connectors. In addition, interference caused by high speed signal transmission in the signal traces is reduced. The spacing of the front connectors 2151 to 215N also distributes the mechanical stress to achieve mechanical stability when the connectors are snapped to the corresponding mating connectors. Similarly, the front card 220 has N front connectors 2251 to 225N located at one side of the card. The front connectors 2251 to 225N are arranged to provide contact points for the signal traces 2281 to 228N, respectively. The front connectors 2251 to 225N are spaced such that there are sufficient gaps between two adjacent connectors.

The mating connectors 2451 to 245N couple to the corresponding front connectors 2151 to 215N and 2251 to 225N. The mating connectors are positioned in a substantially orthogonal direction to the corresponding front card connectors. For example, when the front cards 210 and 220 are positioned vertically, the mating connectors are positioned horizontally. Similarly when the front cards 210 and 220 are positioned horizontally, the mating connectors are positioned vertically. In this configuration, the mating connector 2451 couples to the front connector 2151 and 2251, the mating connector 2452 couples to the front connectors 2152 to 2252, etc.

Each of the mating connectors 2451 to 245N has a suitable number of receptacles to mate to the front cards. The number of receptacles on each mating connectors depends on the number of front cards used in the system. In the exemplary configuration shown in FIG. 2, each of the mating connectors 2451 to 245N has two receptacles 242j and 244j (j=1, . . . , N) positioned to correspond to the front cards 210 and 220. Each of the receptacles provides contact points to match to contact points in the corresponding front connectors.

The rear cards 2401 to 240N are coupled to the mating connectors 2451 to 245N, respectively. The mating connectors 2451 to 245N may be mechanically integrated to or separated from the corresponding rear cards 2401 to 240N. Each of the mating connectors is located alongside the corresponding rear card. The rear cards 2401 to 240N are positioned in a substantially orthogonal direction to the front cards 210 and 220. The result is that the front connectors are connected to the corresponding mating connectors in a back-to-back configuration. Each of the rear cards has rear signal traces to electrically connect the contacts in the corresponding front connectors. For example, the rear card 2401 has signal traces 248 to electrically connect the contacts in the front connector 2151 to the contacts in the front connector 2251.

Since the rear signal traces on a rear card electrically connect only a small number of signal traces on each of the front cards, the routing for the signal traces is simple and flexible. The signal trace lengths on the rear card are substantially short, resulting short propagation delays to accommodate high speed transmission. In addition, the number of routing layers on each of the N rear cards can be made small due to the small number of interconnections, resulting in low cost. Furthermore, the signal density can be increased because of the higher number of contacts in the connectors. Lastly, having a number of rear cards mating to the front cards distributes the overall mechanical stress of the system, resulting in a stable and balanced mechanical support.

Figure 3:
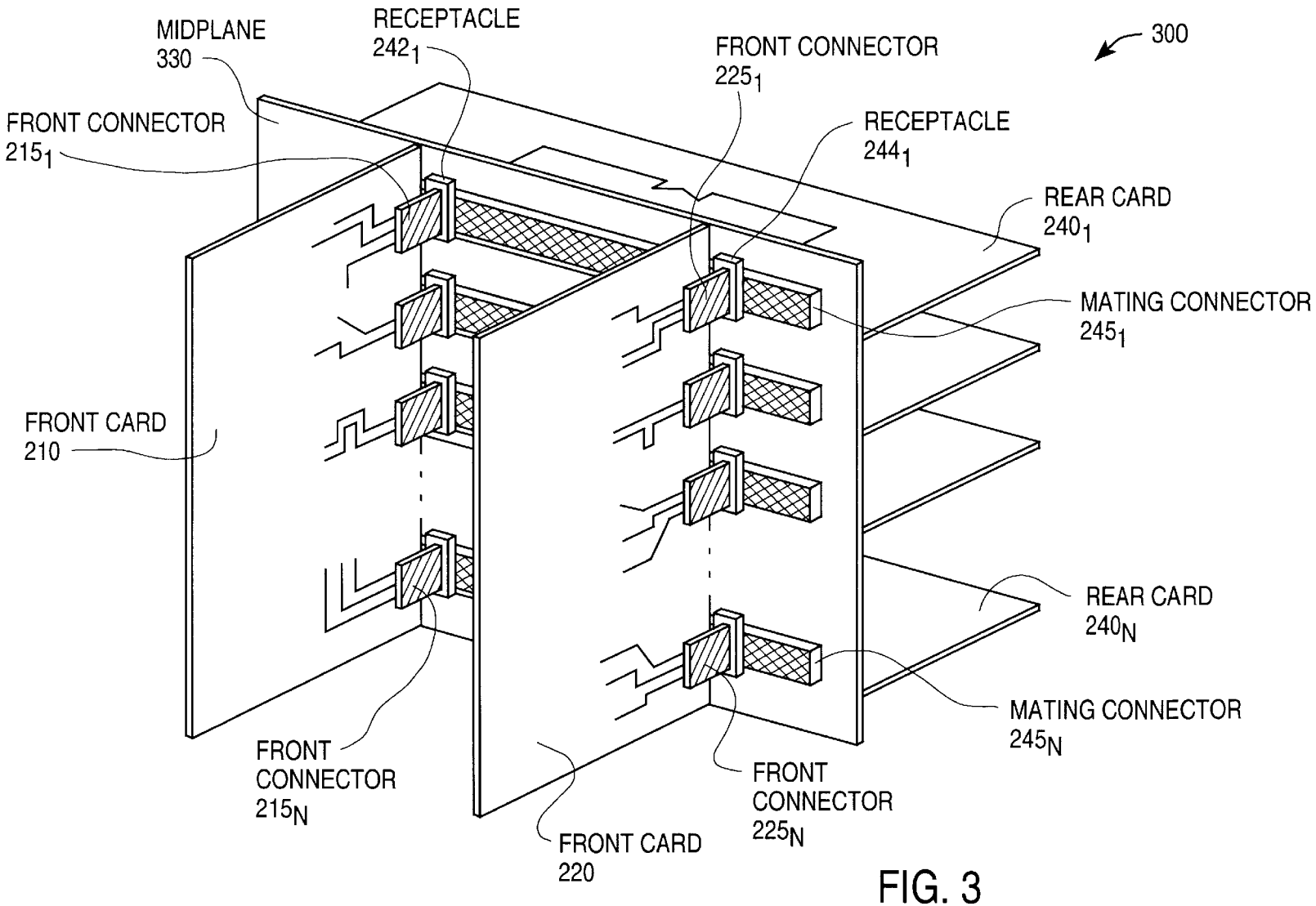
FIG. 3 is a diagram illustrating an interconnection system using orthogonal connectors with midplane according to one embodiment of the invention.

FIG. 3 is a diagram illustrating an interconnection system 300 using orthogonal connectors with midplane according to one embodiment of the invention. The system 300 is essentially similar to the system 200 shown in FIG. 2 except for the addition of a midplane 330.

The midplane 330 is coupled to the mating connectors 2451 to 245N and positioned in a substantially orthogonal direction to the first, second, and rear cards 210, 220, and 2401 to 240N. In essence, the front cards 210 and 220, the midplane 330, and the rear cards 2401 to 240N are positioned in parallel with the orientation of a xyz coordinate system.

The midplane 330 provides additional area for running signal traces to electrically connect the contacts in the front connectors 2151 to 215N and the contacts in the front connectors 2251 to 225N. For example, the midplane signal traces may electrically connect contacts in the front connector 215*i* to contacts in the front connector 215*j* or 225*k* where I, j, k=1, . . . , N. Since most electrical connections are made by the signal traces on the rear cards 2401 to 240N, the signal traces on the midplane 330 can be made short, resulting in high speed transmission for the signals in the front connectors 210 and 220. Furthermore, the midplane 330 provides additional mechanical support for the front cards 210 and 220 and the rear cards 2401 to 240N.

The midplane 330 can also be positioned such that the mating connectors are shifted with respect to the corresponding front connectors in an offset back-to-back configuration. The signal traces from the front connectors to the receptacles in the corresponding mating connectors on the midplane 330 can be made very short according to the shift distance. When the front cards are positioned vertically, the shift direction is also vertical.

Figure 4:
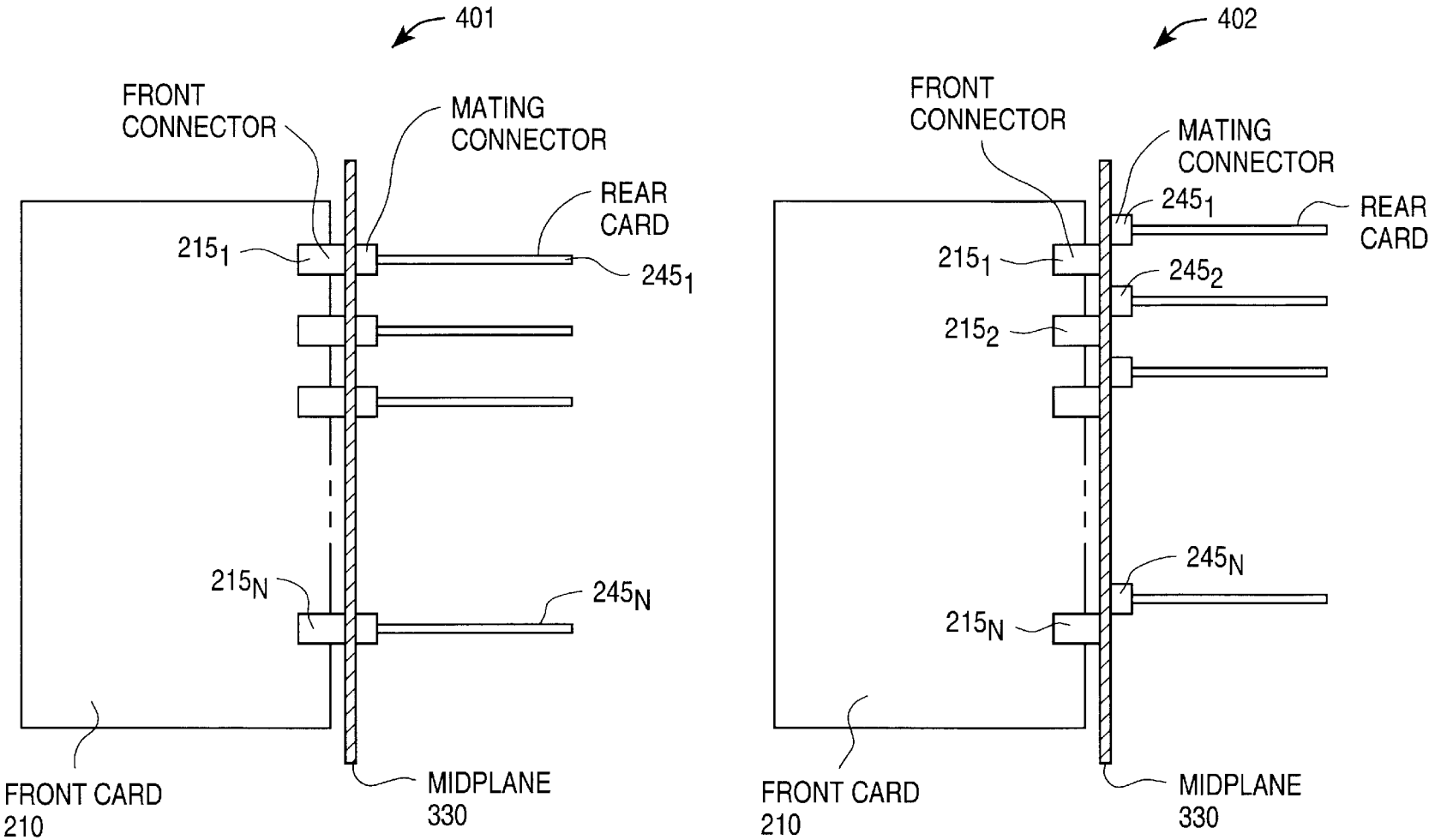
FIG. 4 is a diagram illustrating side views of the interconnection system using orthogonal connectors with midplane according to one embodiment of the invention.

FIG. 4 is a diagram illustrating side views 401 and 402 of the interconnection system using orthogonal connectors with midplane according to one embodiment of the invention. The side view 401 shows the back-to-back configuration and the side view 402 shows the offset back-to-back configuration.

The side view 401 shows the coupling between the front connectors 2151 to 215N to the mating connectors 2451 to 245N in a direct opposite manner. The side view 402 shows the midplane 330 being shifted vertically such that the front connectors 2151 to 215N are interpersed with the mating connectors 2451 to 245N.

While this invention has been described with reference to illustrative embodiments, this description is not intended to be construed in a limiting sense. Various modifications of the illustrative embodiments, as well as other embodiments of the invention, which are apparent to persons skilled in the art to which the invention pertains are deemed to lie within the spirit and scope of the invention.

What is claimed is:

1. An interconnection system comprising:

a first front connector located at a side of a first front card to provide first contacts for first signal traces on the first front card;

a second front connector located at a side of a second front card to provide second contacts for second signal traces on the second front card;

a mating connector having first and second receptacles and located along a side of a rear card to electrically connect the first contacts of the first signal traces to the second contacts of the second signal traces via contacts in the first and second receptacles, the first and second receptacles coupling to the first and second front connectors, respectively, the rear card being positioned in a substantially orthogonal direction to the first and second front cards, the first and second receptacles having contacts to electrically connect the first contacts to the second contacts via rear signal traces on the rear card; and a midplane coupled to the mating connector and positioned in a substantially orthogonal direction to the first, second, and rear cards, the midplane being positioned such that the mating connector is vertically shifted with respect to the first and second front connectors, the midplane having signal traces connecting the contacts in the first and second connectors to the contacts in first and second receptacles, respectively.

2. A method for interconnecting first and second front cards, the method comprising:

providing first contacts for first signal traces on the first front card by a first front connector located at a side of the first front card;

providing second contacts for second signal traces on the second front card by a second front connector located at a side of the second front card;

electrically connecting the first contacts of the first signal traces to the second contacts of the second signal traces via contacts in first and second receptacles of a mating connector, the mating connector being located alongside of a rear card, the first and second receptacles coupling to the first and second front connectors, respectively, the rear card being positioned in a substantially orthogonal direction to the first and second front cards, the first and second receptacles having contacts to electrically connect the first contacts to the second contacts via rear signal traces on the rear card; and providing a midplane coupled to the mating connector and positioned in a substantially orthogonal direction to the first, second, and rear cards, the midplane being positioned such that the mating connector is vertically shifted with respect to the first and second front connectors, the midplane having signal traces connecting the contacts in the first and second connectors to the contacts in first and second receptacles, respectively.

3. A system comprising:

a plurality of front cards each having a plurality of front connectors to provide contacts for signal traces on each front card; and a plurality of rear cards coupled to the plurality of front cards via a plurality of mating connectors to electrically connect the corresponding contacts of the signal traces among the plurality of front cards, each of the plurality of mating connectors having a plurality of receptacles and located alongside of each rear card, the plurality of receptacles on each mating connector coupling to the corresponding plurality of front connectors one from each of the plurality of front cards, the rear card being positioned in a substantially orthogonal direction to the plurality of font cards.

4. The system of claim 3 wherein each of the plurality of receptacles on each of the plurality of mating connectors has contacts to electrically connect the corresponding contacts of the plurality of front connectors via rear signal traces on the corresponding rear card.

5. The system of claim 4 further comprises:

a midplane coupled to the plurality of mating connectors and positioned in a substantially orthogonal direction to the plurality of front cards and the plurality of rear cards.

6. The system of claim 5 wherein the midplane is positioned such that the plurality of mating connectors are vertically shifted with respect to the plurality of front connectors on each of the plurality of front cards, the midplane having signal traces connecting the contacts in the plurality of front connectors to the contacts in the plurality of receptacles, respectively.

* * * * *